US008434454B2

(12) United States Patent
Park

(10) Patent No.: US 8,434,454 B2
(45) Date of Patent: May 7, 2013

(54) DUAL CRANKSHAFT ENGINES

(76) Inventor: Gile Jun Yang Park, Burnaby (CA)

( * ) Notice: Subject to any disclaimer, the term of this patent is extended or adjusted under 35 U.S.C. 154(b) by 90 days.

(21) Appl. No.: 13/181,445

(22) Filed: Jul. 12, 2011

(65) Prior Publication Data

US 2011/0265760 A1 Nov. 3, 2011

Related U.S. Application Data

(63) Continuation-in-part of application No. 12/506,567, filed on Jul. 21, 2009, now Pat. No. 8,091,521, which is a continuation-in-part of application No. 11/758, 177, filed on Jun. 5, 2007, now abandoned.

(60) Provisional application No. 60/807,896, filed on Jul. 20, 2006.

(51) Int. Cl.
*F02D 9/08* (2006.01)

(52) U.S. Cl.
USPC ..... 123/403; 123/DIG. 8; 123/198 DB; 123/198 DC; 123/198 F

(58) Field of Classification Search ..... 123/400, 123/403, 336, 337, 442, 319, 198 D, 198 DB, 123/198 DC, 198 F, DIG. 8
See application file for complete search history.

(56) References Cited

U.S. PATENT DOCUMENTS

| | | | | |
|---|---|---|---|---|
| 1,601,548 | A | | 9/1926 | Zier et al. |
| 1,634,468 | A | | 7/1927 | Muller |
| 2,200,744 | A | | 5/1940 | Heinzelmann |
| 2,596,410 | A | | 5/1952 | Jordan |
| 3,537,437 | A | | 11/1970 | Paul et al. |
| 3,581,628 | A | | 6/1971 | Williams |
| 4,069,803 | A | * | 1/1978 | Cataldo ..... 123/198 F |
| 4,367,704 | A | | 1/1983 | Maucher et al. |
| 4,421,217 | A | * | 12/1983 | Vagias ..... 477/6 |
| 4,638,637 | A | | 1/1987 | Kronogard et al. |
| 4,773,372 | A | * | 9/1988 | Stumm et al. ..... 123/399 |
| 5,265,564 | A | | 11/1993 | Dullaway |
| 5,758,610 | A | | 6/1998 | Park |
| 5,771,860 | A | * | 6/1998 | Bernardi ..... 123/352 |
| 6,318,310 | B1 | | 11/2001 | Clarke |
| 6,446,499 | B1 | * | 9/2002 | Inoue ..... 73/114.37 |
| 6,553,977 | B2 | | 4/2003 | Schmitz |
| 6,814,686 | B2 | * | 11/2004 | Carriere et al. ..... 477/6 |
| 6,830,535 | B2 | | 12/2004 | Wylin |
| 7,032,385 | B2 | | 4/2006 | Gray, Jr. |
| 7,080,622 | B1 | | 7/2006 | Belloso |
| 7,300,385 | B2 | * | 11/2007 | Cherry et al. ..... 477/181 |
| 7,685,988 | B2 | * | 3/2010 | Almkvist et al. ..... 123/198 F |
| 7,792,626 | B2 | * | 9/2010 | Eriksson et al. ..... 701/102 |
| 2006/0278181 | A1 | | 12/2006 | Park |

* cited by examiner

*Primary Examiner* — Hai Huynh
(74) *Attorney, Agent, or Firm* — Oyen Wiggs Green & Mutala LLP

(57) ABSTRACT

Engine systems have two or more internal combustion power units. The units are connected to deliver power by way of freewheeling mechanisms so that one of the power units may be stopped or idled while one or more other power units continues to supply power. A control system is configured to shut an air shut off valve and/or disable an ignition and/or fuel injection system to shut down an auxiliary one of the power units.

18 Claims, 9 Drawing Sheets

DUAL CRANKSHAFT ENGINES

CROSS-REFERENCE TO RELATED APPLICATIONS

This application is a continuation-in-part of application Ser. No. 12/506,567 filed on 21 Jul. 2009 which is a continuation-in-part of application Ser. No. 11/758,177, filed Jun. 5, 2007, and claims the benefit under 35 U.S.C. §119 of U.S. application Ser. No. 60/807,896, filed Jul. 20, 2006.

FIELD OF THE INVENTION

The invention relates to engines and in particular to engines in which some cylinders can be disabled for the purpose of conserving fuel at times when maximum power is not required. Some embodiments of the invention provide control systems which facilitate fault-tolerance and provide evenly distributed engine wear.

BACKGROUND

Internal combustion engines are sized to power loads expected in specific applications. In cases where expected loads can vary widely an engine must be sized to power the maximum load required by the application. For example, an engine in a vehicle should deliver sufficient power to achieve a desired acceleration when the vehicle is fully loaded. A problem in many applications is that the average power output required of an engine can be much lower than the maximum power output required by the application. This can result in lower than optimal fuel efficiency.

U.S. Pat. No. 6,318,310 B1, granted Nov. 20, 2001 to Clarke, discloses a dual mode internal combustion engine which may operate in either a power mode or an efficient mode. The engine has two four-cycle combustion chambers and a two-cycle compression/expansion chamber. The valve system is set up to introduce a fluid charge into the compression/expansion cylinder during the power mode. The fluid charge is compressed in the compression/expansion chamber and one of the combustion chambers. During the efficiency mode, the fluid charge is expanded first in one of the combustion chambers and further expanded in the compression/expansion chamber.

U.S. Pat. No. 7,080,622 B1, issued Jul. 25, 2006 to Belloso, discloses a multi-cylinder internal combustion engine for a vehicle which is divided into at least two power producing sub-units designated primary and secondary sub-units. The primary sub-unit operates during all powered movement of the vehicle. The secondary sub-unit is activated only when additional power is needed. When inactive, no fuel is delivered to the secondary sub-unit, and there is no movement of its components. Each sub-unit has its own crankshaft. The crankshafts are connected by a clutch mechanism interactive with a single output shaft that delivers power to wheels of the vehicle.

U.S. Pat. No. 7,032,385 B2, issued Apr. 25, 2006 to Gray, Jr., discloses an internal combustion engine for a vehicle which provides variable displacement by selectively driving one or more engine crankshafts mounted within an engine block. In several embodiments, the crankshafts are connected to a common output shaft with a one-way clutch between the common output shaft and at least one of the crankshafts. In one aspect, starter gearing is independently associated with each of the first and second crankshafts and a starter is provided for selective engagement with the starter gearing of either of the crankshafts. In another aspect, an accessory drive for driving accessory systems of the vehicle receives power from any crankshaft which is operating, yet is isolated from any crankshaft that is not operating by a one-way clutch.

There remains a need for improved efficiency internal combustion engine systems for vehicles and other applications.

SUMMARY OF THE INVENTION

This invention has various aspects. One aspect provides engine systems having two or more power units. Outputs of the power units are combined using freewheeling mechanisms such that power may be delivered by one of the power units or by a combination of the power units. A control system starts and stops the power units on demand to supply the required load.

In some embodiments, an engine system comprises first and second internal combustion power units. Each of the power units comprises a crankshaft driven by at least one reciprocating piston; an air intake system comprising an air shut off valve controlled by an actuator; and a freewheeling mechanism. A power transmission is coupled to receive power from the power units by way of the freewheeling mechanisms. A control system configured to close the air shut off valve on an auxiliary one of the first and second power units in response to a power demand being below a threshold. Closing the air shut-off valve may be combined with other actions to shut down the auxiliary power unit when it is not required. For example, the controller may shut off an ignition system and/or a fuel injection system of the auxiliary power unit when power from the auxiliary power unit is not needed.

Further aspects of the invention and features of example embodiments of the invention are described below and/or illustrated in the accompanying drawings.

DRAWINGS

Example embodiments are illustrated in the drawings. The depicted embodiments are to be considered illustrative rather than restrictive.

DETAILED DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

One aspect of the invention provides internal combustion engine systems that comprise first and second internal combustion power units that can be started independently. A power transmission system transmits power to a driven load. Under low load conditions one of the power units may be running while the other is shut off. Under higher load conditions both power units may be running and used to deliver power. Such systems may be applied in vehicles or in stationary applications.

The power units may operate according to various power cycles. For example, the power units may operate on a two-stroke power cycle or a four stroke power cycle. The power units may be fuel-injected, carbureted or have other fuel systems. The power units may burn gasoline, diesel fuel, gaseous fuels (e.g. propane, natural gas, hydrogen) or other fuels. The power units may have spark ignition, compression ignition or other ignition systems. The power units may comprise any kind of internal combustion reciprocating piston engines.

The internal combustion power units may comprise separate engines. In some embodiments the internal combustion power units share a common engine block. In such embodiments, each power unit may comprise a crankshaft and one or more pistons coupled to drive the crankshaft. The crankshafts may be supported by a common structure. For example, the engine system may have a crankcase that houses crankshafts of two or more power units.

FIGS. 1 through 12 illustrate one example of an engine system having first and second power units that can be independently started. The engine system illustrated in FIGS. 1 to 12 is a self-supercharging engine. Self-supercharging power units are desirable in many applications but are not a required feature.

Figure 1:
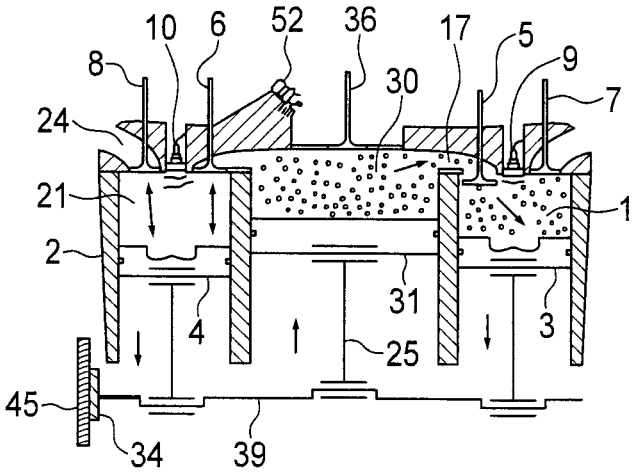
FIG. 1 illustrates a side cut-away view of one of a pair of three-cylinder/piston self-supercharging engines during the air/fuel intake cycle of the first piston/cylinder.

The self-supercharging internal combustion engine system illustrated in FIG. 1 comprises two power units which each comprise three cylinders with three reciprocal pistons connected to drive a respective crankshaft. Two of the pistons in respective cylinders in each power unit fire in alternation while the third piston and cylinder in each power unit is a supercharging piston which receives air/fuel, compresses it and delivers the compressed air/fuel to the first or second cylinder in the power unit in alternating order.

The area of the supercharging piston and cylinder in each power unit may be, for example, at least double the area of the two power pistons in order to provide a supercharging effect. Various arrangements of the cylinders in each power unit are possible. For example, the two power pistons and cylinders in each power unit may be located in a line on either side of the supercharging piston and cylinder. As another example, the cylinders of each power unit may be arranged in a "V"-configuration.

For higher power applications, each power unit may be made with more cylinders or more power units may be provided. In some embodiments the engine system has a number of cylinders which is a multiple of 6.

In one embodiment, two power units are arranged in parallel. A construction providing parallel in-line power units can be advantageous because this configuration can be made to provide better mechanical balancing and less vibration than some other configurations.

FIG. 1 is a side cut-away view of one of the pair of three-cylinder/piston self-supercharging power units during the air/fuel intake cycle of the first piston/cylinder. As seen in FIG. 1, the middle cylinder 30 and piston 31 are at least twice as large in area as each of the adjacent cylinders 1 and 2 and respective pistons 3 and 4. This design provides a supercharging effect when compressed air/fuel is delivered from cylinder 30 to either cylinder 1 or 2, as dictated by respective valves 5 or 6. FIG. 1 also shows a fuel injector 52 over cylinder 30 and freewheeling mechanism 34 and gear 45 at the front of crankshaft 39.

As seen in FIG. 1, the operation of the three pistons and cylinders during the air/fuel intake cycle of the first piston/cylinder is described as follows:

Cylinder 1: As crankshaft 39 rotates, piston 3 moves downward. Exhaust valve 7 is closed. Air/fuel intake valve 5 is open so that compressed pre-mix air/fuel is passed into piston cylinder 1 from middle cylinder 30.

Cylinder 30: As crankshaft 39 rotates, large piston 31 moves upward. Air/fuel intake valve 36 is closed. Pre-mixed air/fuel is compressed and delivered to cylinder 1 through intake port 17 and open valve 5.

Cylinder 2: As crankshaft 39 rotates, air/fuel intake valve 6 and exhaust valve 8 are closed. Spark plug 10 is ignited at the top of cylinder 2 in area 21. The power generated by the ignited compressed air/fuel mixture in cylinder 2 pushes piston 4 downward.

Figure 2:
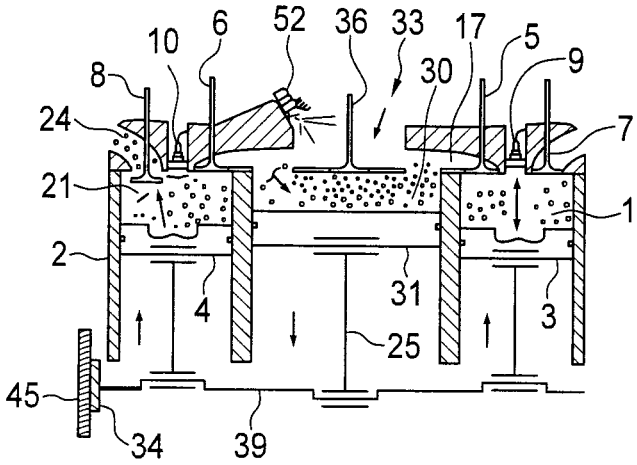
FIG. 2 illustrates a side cut-away view of one of a pair of three-cylinder/piston self-supercharging engines during the air/fuel compression cycle of the first piston/cylinder.

FIG. 2 illustrates a side cut-away view of one of the pair of three-cylinder/piston self-supercharging power units during the air/fuel compression cycle of the first piston/cylinder. The operation of the three piston and cylinders during the air/fuel compression cycle is described as follows:

Cylinder 1: As crankshaft 39 rotates, air/fuel intake valve 5 and exhaust valve 7 are closed. Piston 3 moves upward so that pre-mix air/fuel received from cylinder 30 during the first stage shown in FIG. 1 is compressed in cylinder 1.

Cylinder 30: As crankshaft 39 rotates, middle cylinder piston 31 moves downward. Air/fuel intake valve 36 is open. Air and fuel from fuel injector 52 are drawn into middle cylinder 30 through air/fuel intake port 33.

Cylinder 2: Air/fuel intake valve 6 is closed and exhaust valve 8 is open. Piston 4 moves upward. Exhaust from burnt gas in cylinder 2 is exhausted to atmosphere through exhaust port 24.

Figure 3:
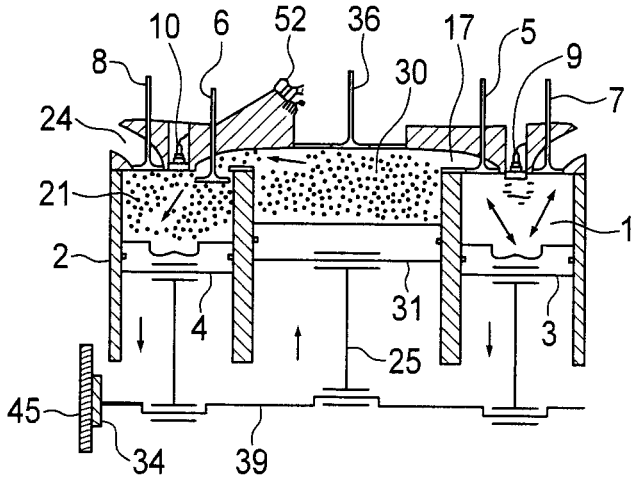
FIG. 3 illustrates a side cut-away view of one of a pair of three-cylinder/piston self-supercharging engines during the combustion cycle of the first piston/cylinder.

FIG. 3 illustrates a side cut-away view one of the pair of three-cylinder/piston self-supercharging power units during the combustion cycle of the first piston/cylinder. The operation of the three piston and cylinders during this combustion cycle is described as follows:

Cylinder 1: As crankshaft 39 rotates, air/fuel intake valve 5 and exhaust valve 7 are closed. Spark plug 9 ignites the compressed air/fuel mixture in combustion chamber 1. Piston 3 is forced downward by the burning air/fuel mixture.

Cylinder 30: As crankshaft 39 rotates, middle cylinder piston 31 is moving upward. Air/fuel intake valve 36 is closed. The compressed air/fuel mixture in cylinder 30 is forced into cylinder 2 through open air/fuel intake valve 6.

Cylinder 2: As crankshaft 39 rotates, piston 4 is moving downward while exhaust valve 8 is closed. Since air/fuel intake valve 6 is open, pre-mix air/fuel from cylinder 30 is delivered into cylinder 2.

Figure 4:
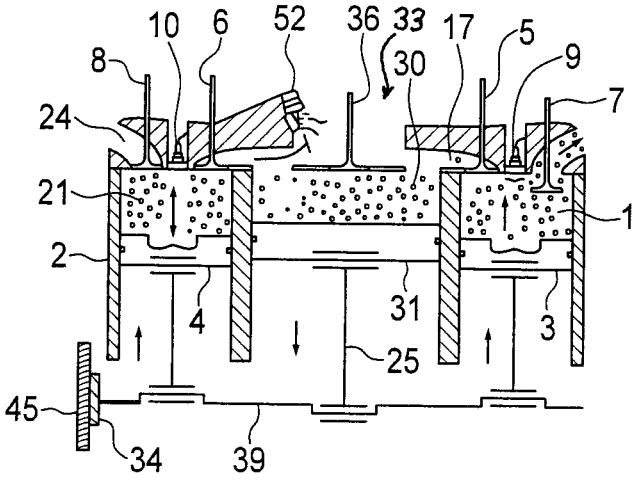
FIG. 4 illustrates a side cut-away view of one of a pair of three-cylinder/piston self-supercharging engines during the exhaust cycle of the first piston/cylinder.

FIG. 4 illustrates a side cut-away view of one of the pair of three-cylinder/piston self-supercharging power units during the exhaust cycle of the first piston/cylinder. The operation of the three pistons and cylinders during this exhaust cycle is described as follows:

Cylinder 1: As crankshaft 39 rotates, piston 3 is moving upward while air/fuel intake valve 5 is closed. Exhaust valve 7 is open so that the exhaust gas in cylinder 1 is vented to atmosphere.

Cylinder 30: As crankshaft 39 rotates, middle piston 31 is moving downward while air/fuel intake valve 36 is open. Air and fuel from fuel injector 52 are taken into middle cylinder 30 through open air/fuel intake port 33.

Cylinder 2: As crankshaft 39 rotates, piston 4 is moving upward while air/fuel intake valve 6 and exhaust valve 8 are closed. Air/fuel pre-mix received previously from cylinder 30 is compressed in cylinder 2.

Figure 5:
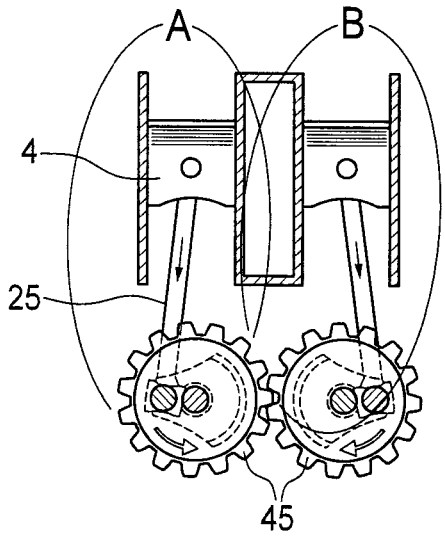
FIG. 5 is a front cut-away view of a pair of three cylinder/piston supercharging engines with dual crankshafts.

FIG. 5 is a front cut-away view of a pair of three cylinder/piston supercharging power units, identified as "A" and "B" with dual crankshafts. In FIG. 5, two sets of three piston/cylinder combinations are arranged in parallel, each connected by connecting rods 25 to separate crankshafts 39 (see FIG. 6) also arranged in parallel. The two crankshafts 39 are connected by meshing gears 45.

Figure 6:
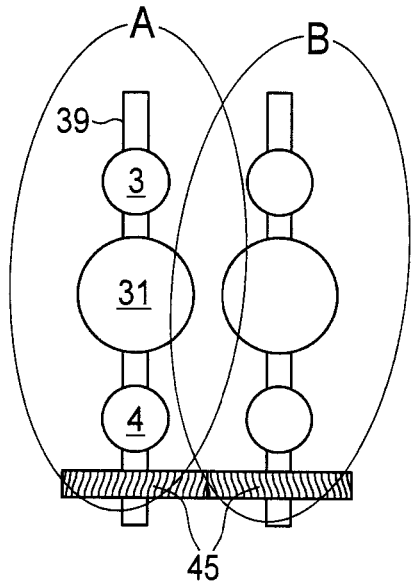
FIG. 6 is a top cut-away view of a pair of three cylinder/piston supercharging engines with dual crankshafts.

FIG. 6 is a top cut-away view of a parallel pair of three cylinder/piston supercharging power units with a pair of parallel crankshafts 39 and meshing gears 45 at the front of each crankshaft.

Figure 7:
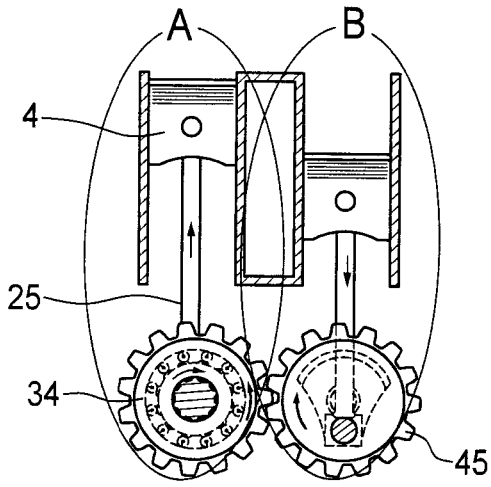
FIG. 7 is a front cut-away view of a pair of three cylinder/piston supercharging engines with dual crankshafts, including a freewheeling mechanism on one of the crankshafts.

FIG. 7 is a front cut-away view of an engine system comprising a pair of three cylinder/piston supercharging power units identified as "A" and "B", with dual crankshafts, including a freewheeling mechanism 34 on one of the crankshafts.

Figure 8:
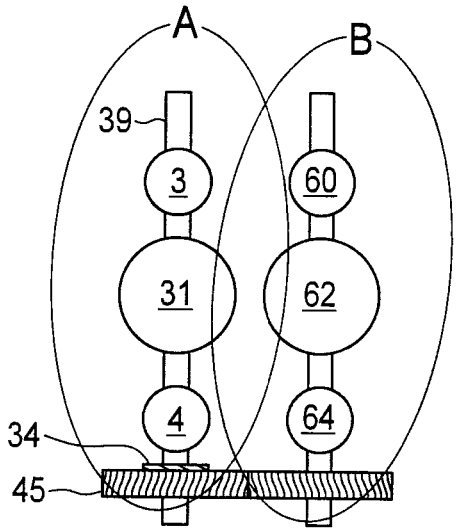
FIG. 8 is a top cut-away view of a pair of three cylinder/piston supercharging engines with dual crankshafts, including a freewheeling mechanism on one of the crankshafts.

FIG. 8 is a top cut-away view of a pair of three cylinder/piston supercharging engines, with dual crankshafts, identified as "A" and "B", including a freewheeling mechanism 34 on one of the crankshafts 39. The two gears 45 mesh with one another.

A freewheeling mechanism is a one-way drive mechanism. Automotive Mechanics, William H. Crouse, 6th Edition, McGraw-Hill, Chapter 31, discloses an example freewheeling mechanism. In a freewheeling mechanism, positive drive is provided by a first shaft or wheel on a second shaft or wheel. However, the second shaft or wheel cannot drive the first wheel or shaft. When the first shaft or wheel is slowed or stopped, the second shaft or wheel "freewheels", and continues turning. In the context of clutches, or planetary gear sets, the freewheeling mechanism is sometimes described as an overrunning clutch. Freewheeling mechanisms can include sprag clutches, centrifugal clutches, bicycle clutches, solenoid clutches, hydraulic clutches, pneumatic clutches, or other suitable clutches.

With the freewheeling mechanism 34 installed on the "A" crankshaft, as shown in FIGS. 7 and 8, the two pistons 60 and 64, powered by fuel injected in the air/fuel compression chamber above piston 62, drive the "B" crankshaft and this action is transferred via gear 45 to the "A" crankshaft. Likewise, the two pistons 3 and 4, powered by fuel injected in the compression chamber 30 above piston 31, drive the "A" crankshaft.

Coupling the outputs of the first and second power units using a freewheeling mechanism permits the first and second power units to be independently controlled. For example, when a vehicle driven by the engine system is coasting, or the engine system is idling, fuel to the "B" set of three pistons may be continued while fuel to the "A" set of three pistons 3, 31 and 4 may be stopped or reduced, thereby conserving fuel. Freewheeling mechanism 34 permits the "B" crankshaft to keep turning while the "A" set of pistons can idle or be stopped and the "A" crankshaft can turn more slowly than the "B" crankshaft or be stopped.

Figure 9:
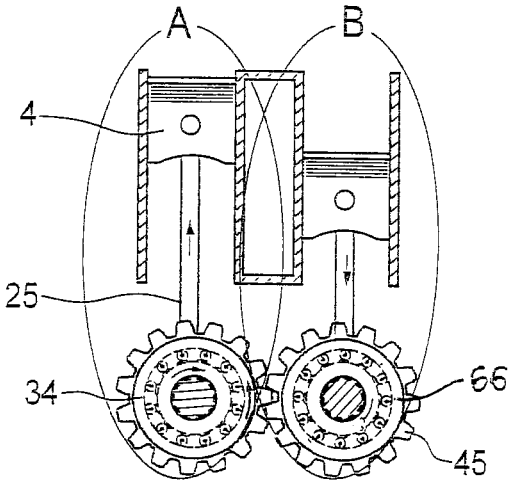
FIG. 9 is a front cut-away view of a pair of three cylinder/piston supercharging engines with dual crankshafts, including freewheeling mechanisms on both crankshafts.
Figure 10:
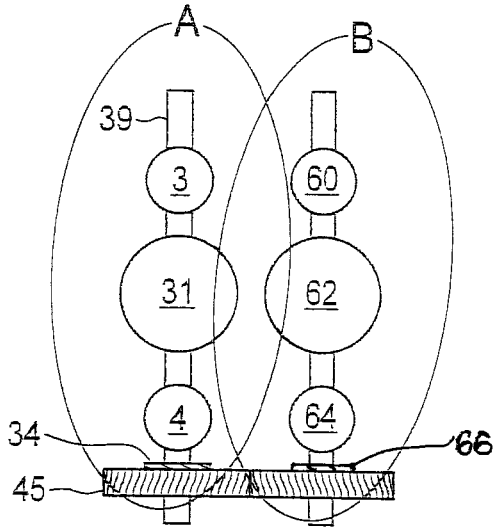
FIG. 10 is a top cut-away view of a pair of three cylinder/piston supercharging engines with dual crankshafts, including a freewheeling mechanism on both crankshafts.

FIG. 9 is a front cut-away view of an engine system according to a third example embodiment comprising a pair of three cylinder/piston supercharging engines with dual crankshafts, including freewheeling mechanisms 34, 66 on both crankshafts. FIG. 10 is a top cut-away view of the engine system show in FIG. 9.

When a second freewheeling mechanism 66 is installed on the "B" crankshaft, as shown in FIGS. 9 and 10, it is possible to idle either the "A" crankshaft and piston/cylinder combination, or the "B" crankshaft and piston/cylinder combination while continuing to run the other crankshaft and piston/cylinder combination. In this way, wear over time can be equalized over time in the engine. Wear tends to occur at a higher rate in the crankshaft and piston/cylinder combination that is powered, than in the idle crankshaft and piston/cylinder combination. Utilizing two freewheeling mechanisms, one on each crankshaft, enables one crankshaft piston/cylinder combination to be the power train for a time, and then the other crankshaft piston/cylinder combination to be the power train for a time.

With a freewheeling mechanism installed in each crankshaft, the engine can be controlled by a PCMS (program computer monitor system) or a PCM (power control module) to enable alternate crankshaft operation. For instance, the "A" crankshaft can run as the primary power train for 5,000 km and then become the idle train. The "B" crankshaft can then be run as the primary power train until it reaches 5,000 km, with the "A" crankshaft as the idle train. In this way, engine wear is equalized in both crankshaft combinations, thereby prolonging the life of the engine.

Another advantage of the dual freewheeling mechanism configuration is that if, for example, the power unit comprising crankshaft "A" breaks down, the vehicle does not need to be towed because it can be driven to a garage for repair by using the power unit comprising crankshaft "B" as the power train.

Figure 11:
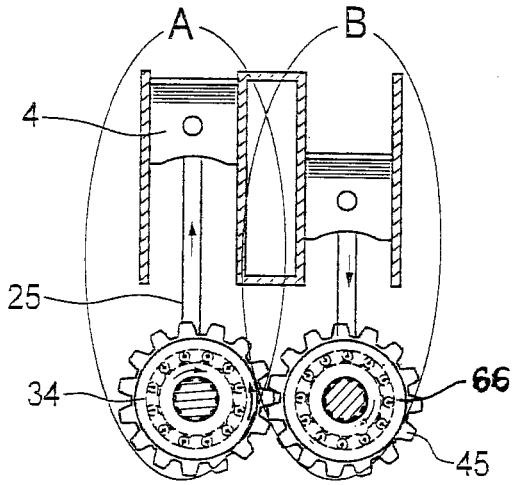
FIG. 11 is a front cut-away view of a pair of three cylinder/piston engines with dual crankshafts and freewheeling mechanisms on both crankshafts.

FIG. 11 is a front cut-away view of a fourth example embodiment including a pair of three cylinder/piston power units with dual crankshafts and freewheeling mechanisms on both crankshafts. The power units in this fourth embodiment can be two-cycle or four-cycle engines.

Figure 12:
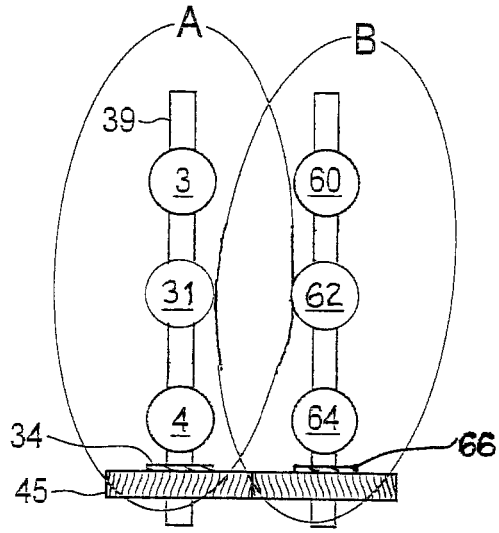
FIG. 12 is a top cut-away view of a pair of three cylinder/piston engines with dual crankshafts, which can be two-cycle or four-cycle engines, and freewheeling mechanisms on both crankshafts.

FIG. 12 is a top cut-away view of a pair of three cylinder/piston power units with dual crankshafts and freewheeling mechanisms on both crankshafts. The dual crankshaft, dual freewheeling embodiment illustrated in FIGS. 11 and 12 can be operated in the same manner as the third embodiment that is illustrated in FIGS. 9 and 10 and discussed above. There is no self-supercharging capability in the fourth embodiment illustrated in FIGS. 11 and 12 because the pistons and cylinders are all of equal diameter.

FIGS. 13 to 16 illustrate a control system that may be applied to control power units in an engine system. In these embodiments the power units are shown as being separate.

However, the power units may and preferably do share a common engine block. In some embodiments the power units are the same. The power units may each have the same number of cylinders. Power from the power units is transmitted by way of a transmission that allows either of the power units to continue to run at a desired rpm while the other power unit is shut off or idling. This may be achieved, for example, by providing freewheeling mechanisms as discussed above. By way of example only, the engine system may have an overall configuration as illustrated in FIGS. 9 and 10 or 11 and 12.

Engine system 100 comprises a first power unit 100A and a second power unit 100B. Power units 100A and 100B comprise air intake systems 102A and 102B, ignition systems 104A and 104B and starters 106A and 106B. Cylinders, pistons and other components of power units 100A and 100B are omitted from FIGS. 13 to 16 for clarity. A selector system 105 controls which one of power units 100A and 100B will be the auxiliary power unit that can be shut down or idled when not needed.

The electric circuits for operating starters 106A and 106B include oil-pressure controlled starter control switches 107A and 107B respectively. When the associated power unit 100A or 100B is running then the corresponding oil-pressure controlled switch 107A or 107B is open so that the corresponding starter 106A or 106B cannot be energized.

Air intake systems 102A and 102B respectively comprise air shut off valves 110A and 110B respectively operated by actuators 112A and 112B. Actuators 112A and 112B also respectively control switches 114A and 114B which are connected in circuits that supply power to ignition systems 104A and 104B respectively. A power unit can be shut down by operating the corresponding actuator 112A or 112B to close the corresponding air shut off valve 110A or 110B and to disable the corresponding ignition system 104A or 104B by way of ignition control switch 114A or 114B.

An accelerator pedal or other throttle control 120 is connected to control the positions of throttle valves 122A and 122B by way of linkages 123A and 123B. When a power unit is running, the power output may be controlled by way of the throttle control 120. Fuel is introduced by way of carburetors 121A and 121B.

Figure 13:
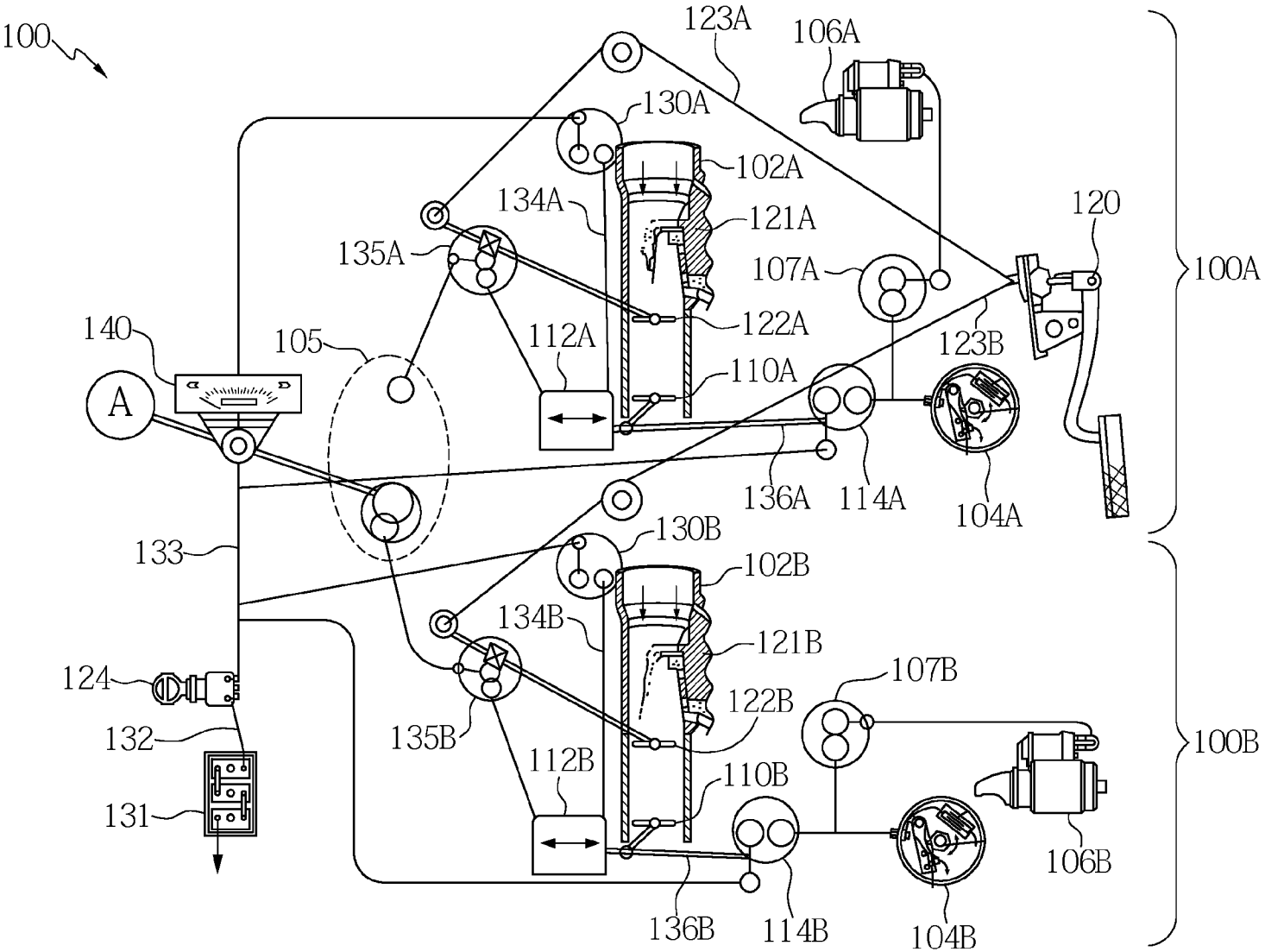
FIGS. 13 to 16 are schematic views of an engine system showing details of a control system configured to turn power units on and off in response to load on the engine system according to an example embodiment.

FIG. 13 shows the engine system 100 with both power units 100A and 100B off. Air shut off valves 110A and 110B are closed. Ignition systems 104A and 104B are disabled by ignition control switches 114A and 114B. Since neither power unit is developing oil pressure, starter control switches 107A and 107B are closed so that the power units can be started. In FIG. 13, selector system 105 is set so that power unit 100A is acting as the main power unit and power unit 100B is acting as an auxiliary power unit.

Figure 14:
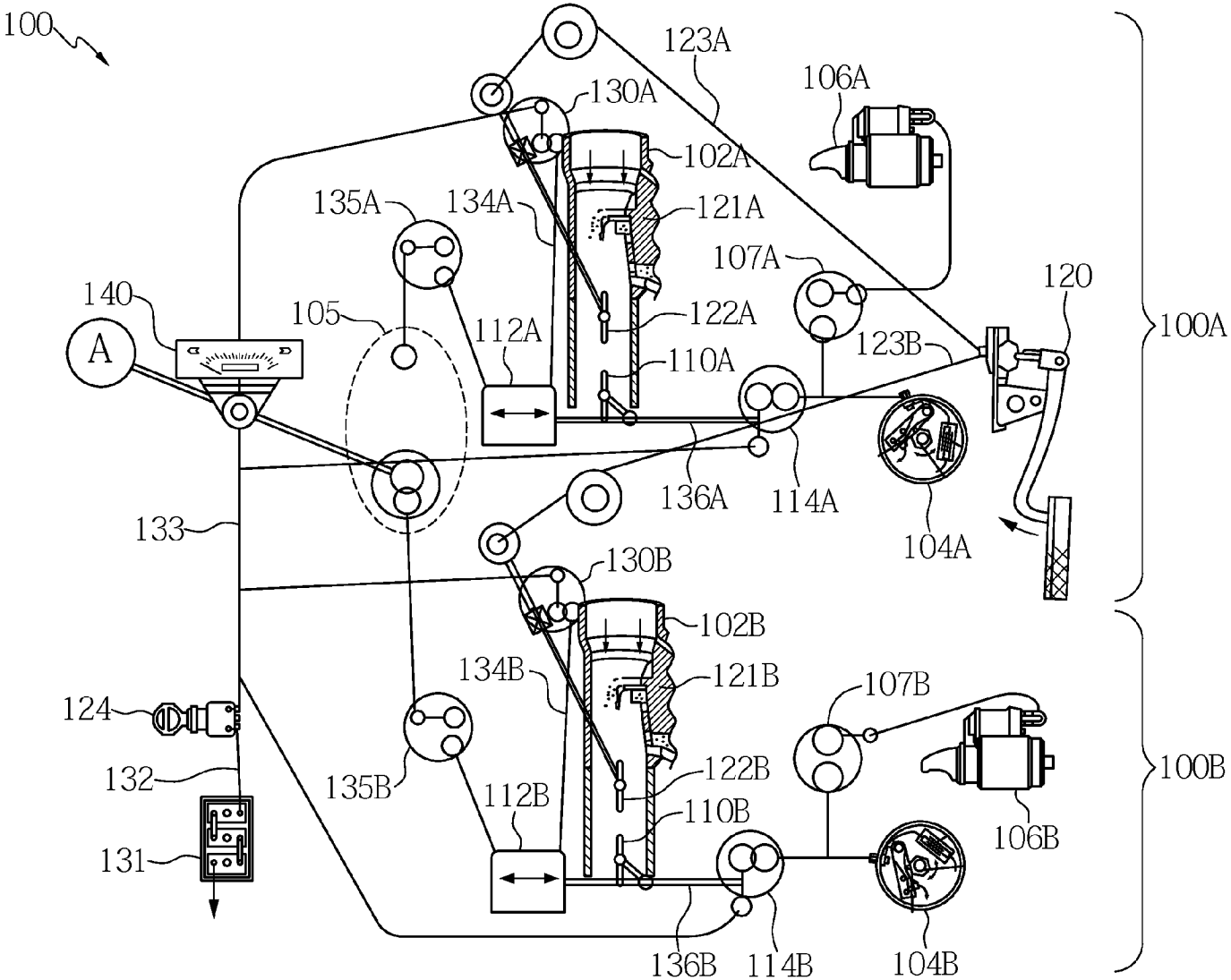

FIG. 14 shows the engine system 100 with both power units 100A and 100B running at full throttle. Air shut off valves 110A and 110B are open. Ignition systems 104A and 104B are enabled by ignition control switches 114A and 114B. Since both power units are developing oil pressure, starter control switches 107A and 107B are open so that starters 106A and 106B cannot be operated.

Starting from the 'OFF' configuration illustrated in FIG. 13, a user can control engine system 100 to switch to the full throttle configuration illustrated in FIG. 14 by applying throttle control 120 with ignition key 124 turned on. When this occurs, throttle position switch 130A is closed in response to the throttle being applied. This allows electrical power to be delivered to actuator 112A from battery 131 by way of wire 132, ignition key switch 124, wire 133, throttle position switch 130A and wire 134A. Actuator 112A then opens air shut off valve 110A and operates switch 114A by way of linkage 136A to supply power to enable ignition system 104A and to operate starter 106A. As soon as power unit 100A is running it generates oil pressure which disables starter 106A by way of starter control switch 107A.

Power unit 100B is started in the same manner as power unit 100A when throttle position switch 130B is closed by the operation of throttle control 120.

Figure 15:
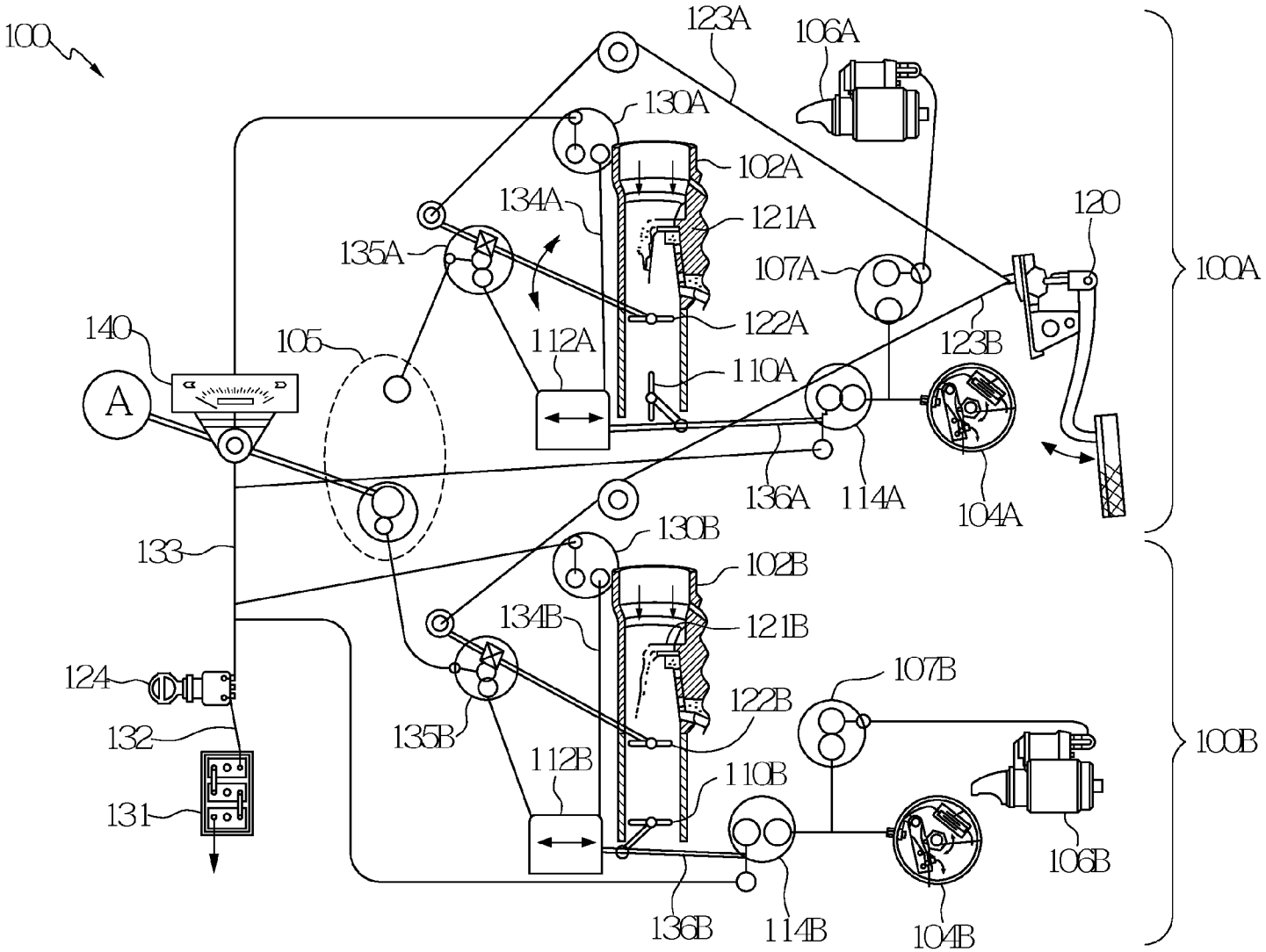

FIG. 15 illustrates a configuration where power unit 100A is running but power unit 100B has been shut down. A user can cause engine system 100 to switch from the configuration shown in FIG. 14 with both power units running to the configuration shown in FIG. 15 with the auxiliary one of the power units (in this case power unit 100B) shut down by moving throttle control 120 to or toward its idle position.

When throttle control 120 is moved toward its idle position it eventually causes throttle position switches 135A and 135B to close. When this occurs, an electrical control input is supplied by way of selector system 105 and throttle position switch 135B to actuator 112B. The control input causes actuator 112B to close air shut off valve 110B and to disable ignition system 104B—thereby turning off power unit 100B. Power unit 100A remains running because selector system 105 is configured not to pass the control signal to actuator 112A.

Figure 16:
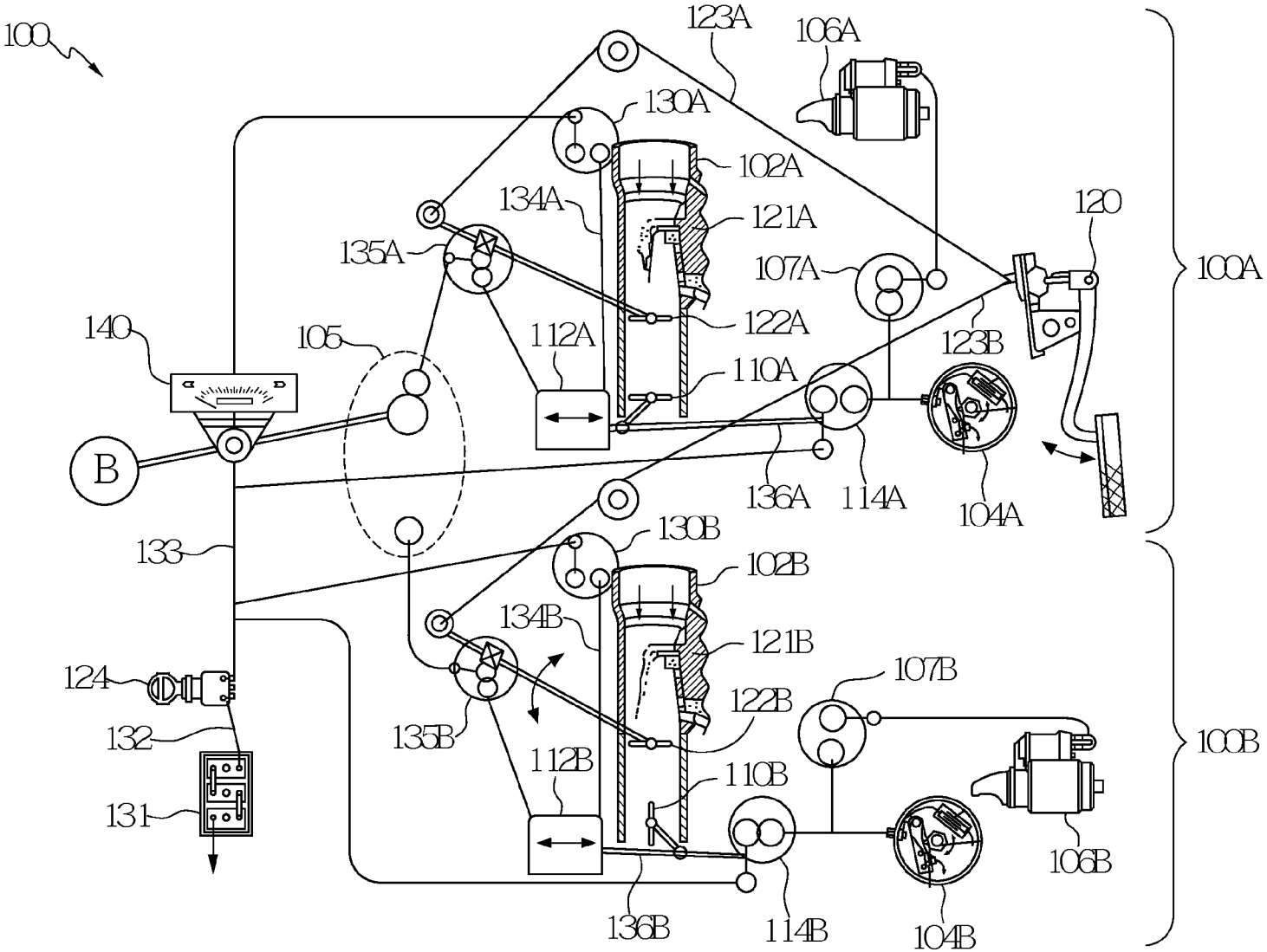

FIG. 16 is similar to FIGS. 13 through 15 except that selector system 105 has been switched to make power unit 100B active as the main power unit while power unit 100A is acting as the auxiliary power unit.

Selector system 105 may be controlled in various manners. In some embodiments, selector system 105 is operated in response to readings of an odometer 140. For example, selector system 105 may be controlled to automatically toggle between setting power unit 100B as the auxiliary power unit (that can be shut down or idled when power demand is low) and setting power unit 100A as the auxiliary power unit. This toggling may occur, for example once every few kilometers, once every few hundred kilometers, once every few thousand kilometers or the like. The precise intervals at which toggling of selector system 105 occurs is not particularly important. It is advantageous that, on average and over time, power units 100A and 100B each experience roughly the same number of revolutions under load.

Selector system 105 may optionally or in the alternative comprise a manual selector switch that permits a user to manually select which power unit acts as the auxiliary power unit. The user may, for example periodically manually change the position of the selector switch.

Selector system 105 may optionally comprise switches that force one of power units 100A and 100B to remain OFF. Such switches may be manually controlled or controlled automatically. Such switches may be used, for example, in a case where one of power units 100A and 100B is experiencing mechanical or other faults. In such cases, the faulty power unit may be forced to stay OFF while the other power unit is made the main power unit.

For the case where engine system 100 is installed to drive a vehicle it can be seen that a driver can achieve full power by fully depressing throttle control 120. This causes both power units to start if they are not already running. Where lower power is needed (for example while driving down a hill or on flat terrain) the drive will ease off on throttle control 120. This may allow whichever one of the power units that is currently the auxiliary power unit to shut down. Driving continues using the main power unit. If the driver encounters a hill or needs to accelerate to pass or the like the driver can cause the auxiliary power unit to start automatically by depressing throttle control 120.

The above description of FIGS. 13 to 16 has used electrical control circuits as an example to illustrate a simple way in which the invention may be implemented. Other embodiments may use a more sophisticated control system, such as a programmable engine controller or the like that controls air shut off valves 110A and 110B, ignition systems 104A and 104B and starters 106A and 106B by way of control signals delivered by way of suitable signal lines. A manner of operation like that described above may be implemented by such a control system. For example, in times of reduced power demand one of the power units may be automatically shut down or placed in a reduced power mode. In times of increased power demand, both power units may be run together to supply the required power.

In some embodiments, a control system takes as input one or more of: a throttle position sensed by a throttle position sensor and a computed engine load. In response to the control input the control system determines whether to run only one of the power units or whether to run both of the power units. The control system may comprise a programmable processor that automatically controls starting of the power units, as needed, by way of starters 106A and 106B and automatically shuts off one or both of the power units under conditions of low or no load. The control system may control each of air shut off valves 110A and 110B to be closed when the associated power unit is not running.

In some embodiments the control system controls a fuel injection system instead of or in addition to an ignition system. In such embodiments the control system may be configured to inhibit operation of the fuel injection system to shut down an auxiliary power unit during times of low power demand.

Figure 17:
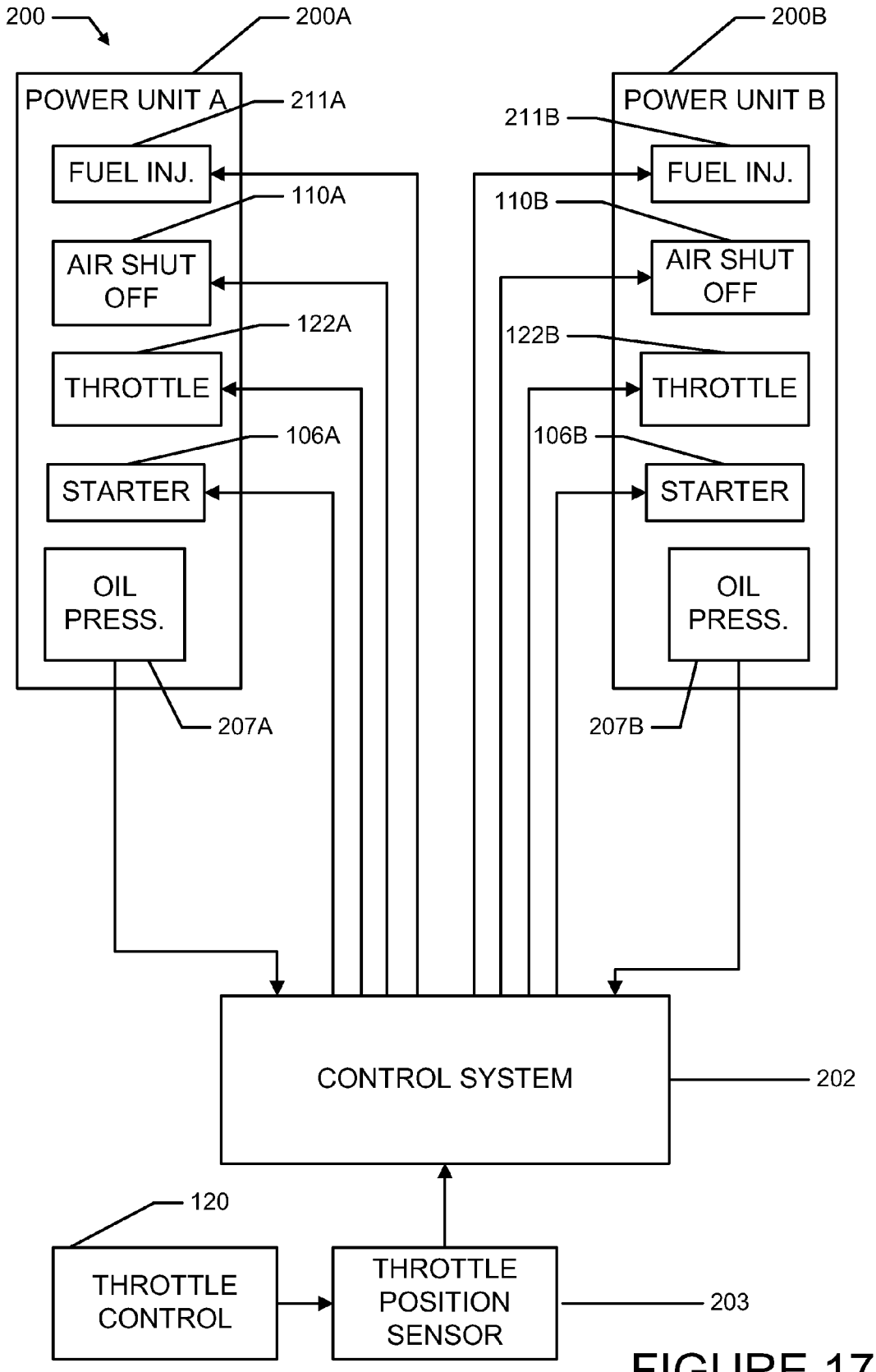
FIG. 17 is a schematic block diagram showing a control system according to another example embodiment.

FIG. 17 is a schematic block diagram showing an engine system 200 which is controlled by an electronic control system 202. Engine system 200 may operate in substantially the same way as engine system 100. Engine system 200 has power units 200A and 200B. Each power unit 200A and 200B comprises an internal combustion engine that can be run independently of the other. In some embodiments, power units 200A and 200B share a common crankcase as described above for power units 100A and 100B.

Control system 202 embodies logic that controls the operation of power units 200A and 200B. Specifically, control system 202 controls starting and shutting down of power units 200A and 200B. Where power units 200A and 200B comprise electronic engine controllers, control system 202 may be separate from or integrated with such engine controllers. It can be advantageous for control system 202 to be integrated with one or more engine controllers that control power units 200A and 200B because control system 202 can usefully apply information that is also useful for and/or developed during the operation of electronic engine control units.

In the illustrated embodiment, control unit 202 receives an input from a throttle position sensor 203 connected to monitor a position of a throttle control 120. Control unit 202 may additionally or in the alternative receive an input indicative of the current load on engine system 200. Control system 202 is also connected to receive signals indicative of the status and proper functioning of power units 200A and 200B. For example, control system 202 may receive inputs from oil pressure sensors 207A and 207B, fuel pressure sensors (not shown), tachometers (not shown) and/or other sensors.

Control system 202 is connected by way of suitable interfaces to control the running of power units 200A and 200B. For example, control system 202 may be connected to control: some or all of starters 106A and 106B, air shut off valves 110A and 110B (when present), fuel injection systems 211A and 211B (when present), and/or throttle valves 122A and 122B (when present) of power units 200A and 200B.

By executing hard-wired or programmable logic, control system 202 may assign roles (main power unit and auxiliary power unit) to power units 200A and 200B—essentially performing the same function as the selector system 105 illustrated in FIGS. 13 to 16. Control system 202 may be configured to switch these roles on the occurrence of certain conditions. For example, control system 202 may be configured to switch the roles of power units 200A and 200B upon the occurrence of one or a combination of:

- the main power unit has passed a certain number of crankshaft revolutions since the last role switch;
- where the engine system is in a vehicle, the vehicle has traveled a certain distance since the last role switch;
- a product of load multiplied by time for the main power unit has reached a certain accumulated value since the last role switch;
- the main power unit has consumed a certain amount of fuel since the last role switch;
- the main power unit is malfunctioning; and
- the like.

In some embodiments, control system 202 implements a role switch when engine system is re-started after a role-switch event rather than switching roles of main and auxiliary power units when engine system 200 is running.

Control system 202 may switch main power unit 200A or 200B on when required (for example upon detecting that a user has applied a control input to throttle control 120) and shut main power unit 200A or 200B off (for example when there is no load on engine system 200 or when there has been no load on engine system 200 for some time period).

When main power unit 200A or 200B is running, control system 202 may automatically switch auxiliary power unit 200B or 200A on when required (for example, when the load required from engine system 200 is above a threshold). Control system 202 may automatically idle auxiliary power unit 200B or 200A or switch auxiliary power unit 200B or 200A off when required (for example, where the load on engine system 200 is below a threshold).

While a number of exemplary aspects and embodiments have been discussed above, those of skill in the art will recognize certain modifications, permutations, additions and sub-combinations thereof. For example, the number of power units in an engine system as described herein is not limited to two. An engine system may comprise, 3, 4, 5 or more power units. Each of the power units may comprise a desired number of cylinders. For example, a power unit may have one, two, three, four, five or more cylinders. In some embodiments, the power units are the same. In other embodiments, one or more power units are different from other ones of the power units.

The power units may all share a common engine block and/or a common crankcase. In alternative embodiments, the power units comprise separate engines and output power from the power units are combined by a transmission system that includes freewheeling mechanisms so that each of the power units can be started or shut down independently while any one or any combination of the power units may pass power to a driven load by way of the transmission system. The transmission system may comprise any suitable mechanisms for transferring mechanical power including mechanisms such as belts, chains, gears, shafts, and the like.

It is therefore intended that the following appended claims and claims hereafter introduced are interpreted to include all such modifications, permutations, additions and sub-combinations.

What is claimed is:

1. An engine system comprising:

first and second internal combustion power units, each of the power units comprising:

a crankshaft driven by at least one reciprocating piston; and an air intake system comprising an air shut off valve controlled by an actuator; and a freewheeling mechanism;

a power transmission coupled to receive power from the power units by way of the freewheeling mechanism;

a control system configured to close the air shut off valve on an auxiliary one of the first and second power units in response to a power demand being below a threshold.

2. An engine system according to claim 1 comprising a selector system operable to selectively configure either one of the first and second power units as the auxiliary power unit.

3. An engine system according to claim 2 wherein the selector system comprises an odometer and is configured to toggle between configuring the first power unit as the auxiliary power unit and configuring the second power unit as the auxiliary power unit based on distance traveled as determined by the odometer.

4. An engine system according to claim 2 wherein the selector system is configured to toggle between configuring the first power unit as the auxiliary power unit and the second power unit as a main power unit and configuring the second power unit as the auxiliary power unit and the first power unit as the main power unit based on the occurrence of one or a combination of:

the main power unit has passed a certain number of crankshaft revolutions;

where the engine system is in a vehicle, the vehicle has traveled a certain distance;

a product of load multiplied by time for the main power unit has reached a certain accumulated value;

the main power unit has consumed a certain amount of fuel; and the main power unit is malfunctioning.

5. An engine system according to claim 4 wherein each of the power units comprises an ignition system and the control system is configured to disable the ignition system of the auxiliary one of the first and second power units in response to the power demand being below the threshold.

6. An engine system according to claim 5 wherein the control system comprises a throttle position sensor and is configured to control the air shut off valve and ignition of the auxiliary power unit based on a throttle position determined by the throttle position sensor.

7. An engine system according to claim 4 wherein each of the power units comprises a fuel injection system and the control system is configured to disable injection of fuel by the fuel injection system of the auxiliary one of the first and second power units in response to the power demand being below the threshold.

8. An engine system according to claim 4 wherein the crankshafts of the first and second power units are mounted in a common crankcase.

9. An engine system according to claim 8 wherein each of the power units comprises a starter operable to start the power unit and the engine system comprises a circuit configured to energize the starter of the auxiliary one of the power units in response to a power demand exceeding a second threshold.

10. An engine system according to claim 9 wherein each of the power units comprises a self-supercharging internal combustion engine.

11. An engine system according to claim 9 wherein the engine system comprises three or more of the power units.

12. An engine system according to claim 9 wherein the air intake system of each of the power units comprises an intake passage, the air shut off valve is located to restrict air from flowing in the intake passage and the power unit comprises a throttle valve located in the intake passage and operable to control a flow of air in the intake passage.

13. An engine system according to claim 9 wherein each of the power units comprises a separate lubricating oil pump.

14. An engine system according to claim 13 wherein each of the power units comprises an oil-pressure activated switch connected to inhibit operation of the starter for the power unit when oil pressure in the power unit exceeds a threshold.

15. A method for providing mechanical power to drive a load, the method comprising:

providing a plurality of power units, each of the power units comprising:

a crankshaft driven by at least one reciprocating piston; and an air intake system comprising an air shut off valve controlled by an actuator; and a freewheeling mechanism;

delivering power to the load by way of a power transmission coupled to receive power from the power units by way of the freewheeling mechanisms; and in response to a power demand being below a threshold, automatically shutting down an auxiliary one of the first and second power units by closing the air shut-off valve of the auxiliary power unit.

16. An engine system according to claim 1 wherein at least one of the power units comprises a two-cycle engine.

17. An engine system according to claim 1 wherein at least one of the power units comprises a four-cycle engine.

18. An engine system according to claim 1 wherein, in at least one of the power units, the crankshaft is driven by a plurality of reciprocating pistons.

* * * * *